United States Patent [19]

Krause et al.

[11] Patent Number: 4,973,004

[45] Date of Patent: Nov. 27, 1990

[54] HOUSING FOR A PAPER SHREDDER

[75] Inventors: Klaus-Diether Krause, Dienthofen; Florian Stolzenberger, Schwanstetten; Rudolf Schmeykal, Hemhofen, all of Fed. Rep. of Germany

[73] Assignee: Ta Triumph-Adler Aktiengesellschaft, Nuremberg, Fed. Rep. of Germany

[21] Appl. No.: 419,798

[22] Filed: Oct. 10, 1989

[30] Foreign Application Priority Data

Oct. 21, 1988 [DE] Fed. Rep. of Germany ..... 3835822

[51] Int. Cl.[5] ..... B02C 19/00

[52] U.S. Cl. ..... 241/100; 241/235; 241/242

[58] Field of Search ..... 241/100, 235, 236, 242, 241/243

[56] References Cited

U.S. PATENT DOCUMENTS

| | | | |
|---|---|---|---|
| 4,637,560 | 1/1987 | Goldhammer | 241/100 |
| 4,700,902 | 10/1987 | Yeomans | 241/100 |
| 4,757,565 | 8/1986 | Hatanaka | 241/100 |
| 4,828,188 | 5/1989 | Snyder | 241/100 X |

FOREIGN PATENT DOCUMENTS

| | | |
|---|---|---|
| 2812807 | 10/1978 | Fed. Rep. of Germany . |
| 1022409 | 5/1964 | United Kingdom . |

*Primary Examiner*—Timothy V. Eley

*Attorney, Agent, or Firm*—Browdy and Neimark

[57] ABSTRACT

A housing for a paper shredder with a slit-like paper feed disposed on one side of the housing and a slit-like paper discharge disposed on the opposite side of the housing. The housing has an elongated shape, the dimension of length being a multiple of the dimension in width, where on each narrow side of the paper discharge support surfaces are disposed, with which the paper shredder can be placed on a waste receptacle. The width of the support surface is selected such, that one of the support surfaces is considerably larger than the width of the edge of the waste receptacle, while the other support surface has a width only negligibly greater than the width of the edge of the waste receptacle. It is additionally possible to provide a clamping device in the area of one support surface as security against sliding of the paper shredder placed on the waste receptacle.

7 Claims, 2 Drawing Sheets

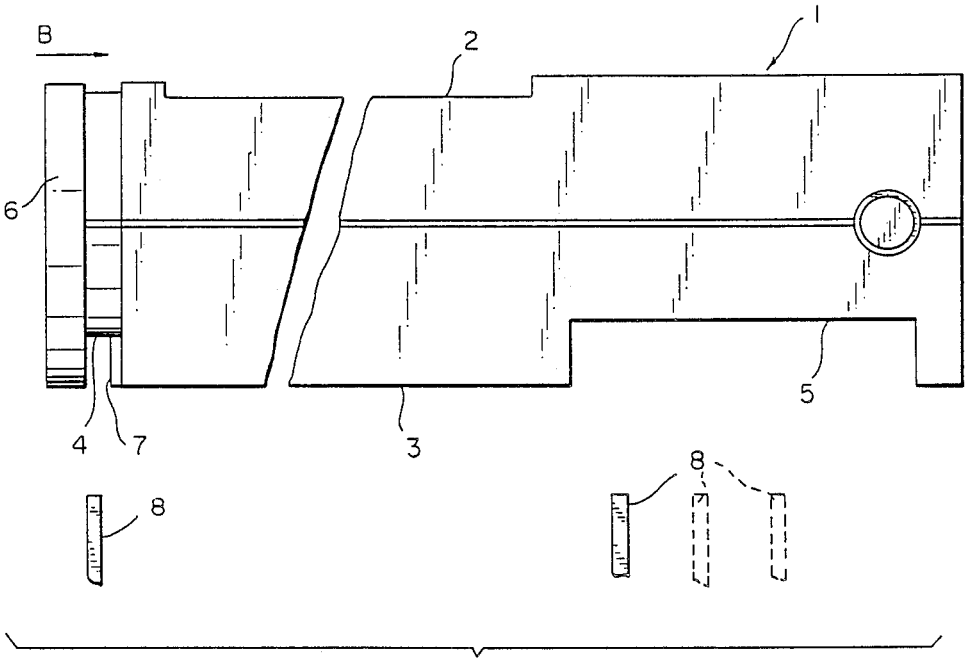
FIG. 1A
FIG. 1B
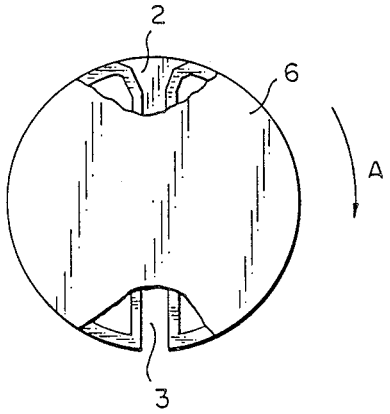

HOUSING FOR A PAPER SHREDDER

BACKGROUND OF THE INVENTION

1. Field of the Invention

The invention relates to a housing for a paper shredder with a slit-like paper feed on one side of the housing and a slit-like paper discharge on the opposite side of the housing.

2. The Prior Art

Paper shredders of the type mentioned above are often designed in such a way that they can be placed directly on top of an accordingly shaped waste receptacle intended for the corresponding paper shredder, or they are located on a support device under which a conventional waste receptacle can be placed, so that the waste paper can be received directly by the receptacle.

It is disadvantageous in such devices that in the one case the waste receptacle is connected directly with the paper shredder and therefore is not available for other purposes and, in the other case, the waste receptacle is placed under the paper shredder in such a way that it must be pulled out from under it in order to receive other waste.

SUMMARY OF THE INVENTION

It is therefore an object of the invention to design a housing for a paper shredder in such a way that the paper shredder can be placed on commercially available waste receptacles of various types. This object is attained by providing that the housing for the paper shredder has an elongated shape, the length dimension being a multiple of the width dimension, wherein on each narrow side of the paper discharge, support surfaces are disposed, with which the paper shredder can be placed on a waste receptacle.

One advantage of the shape of the housing of the paper shredder in accordance with the present invention lies in that the paper shredder can be placed on top of all waste receptacles (waste paper baskets) commonly used in offices. One support surface has a width in the direction in which the slit-like paper discharge extends, which is considerably greater than the width of the edge of the waste receptacle, whereas the other support surface has a width only insignificantly greater than the width of the edge of the waste receptacle. This counteracts the possibility that the paper shredder might slide when placed atop a receptacle.

An even more extensive securing against sliding of the paper shredder placed on the waste receptacle is achieved by means of a clamping device, in accordance with the present invention, which is provided on at least one support surface by means of which the paper shredder can be clamped to at least one edge of the waste receptacle. The clamping device comprises a contact surface, limiting the one support surface in the direction in the paper discharge and the housing cover, which is spring loaded in the direction towards the contact surface. The housing cover may be connected by means of a thread with the housing of the paper shredder, so that the clamping effect takes place between the housing cover and the contact surface when rotating the housing cover. Alternatively, a securing ring may be connected via an inner thread with the housing of the paper shredder, the inner thread of the securing ring cooperating with an interior thread located on the jacket surface of the housing in the area of the one support surface, so that the clamping effect between the securing ring and the support surface takes place by rotating the securing ring.

Another embodiment of the housing of the paper shredder is provided in which the housing has a generally cylindrical shape and the support surfaces are formed by flattened portions on both sides of the paper discharge. This embodiment is of particular advantage since because of it the paper shredder only covers a small part of the mostly circular opening of the waste receptacle.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

The invention of the present application will now be described in more detail with reference to the preferred embodiments of the device, given only by way of example, and with reference to the accompanying drawings, in which:

FIG. 1A shows the front face and FIG. 1B shows a lateral view of a paper shredder according to the present invention;

DETAILED DESCRIPTION OF THE PREFERRED EMBODIMENTS

Figure 2:
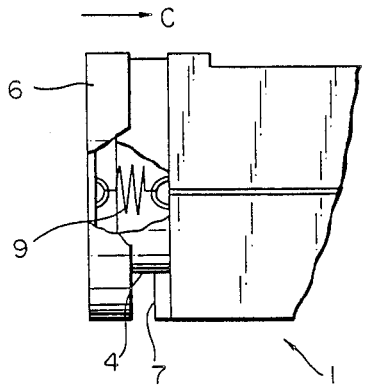
FIG. 2 shows another embodiment of the present invention including a spring acting on the cover of the paper shredder.

The FIG. 1 shows the front face and a lateral view of a paper shredder 1, in general of cylindrical form, having on one side a slit-like paper feed 2 and on the opposite side a slit-like paper discharge 3. Support surfaces 4 and 5 are provided on either side of the paper discharge 3 which are formed by a flattening of the cylinder-shaped housing. A housing cover 6, closing one of the faces of the housing of the paper shredder, is acted upon by a spring 9 shown in FIG. 2, the spring 9 acting in the direction of arrow C towards a contact surface 7, which limits the support surface 4 in the direction towards the paper discharge 3.

Because of the relatively wide shape of the support surface 5 it is possible to pl ace the paper shredder on waste receptacles 8 of varied widths. The clamping device formed by the housing cover 6, which is under the influence of the spring 9, and the contact surface 7, secures the paper shredder 1, placed on the waste receptacle 8, against sliding.

Figure 3A:
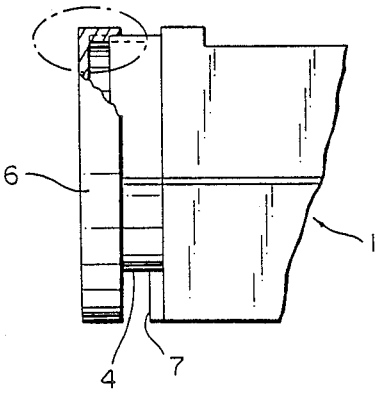
FIG. 3A shows another embodiment of the present invention including a thread.
Figure 3B:
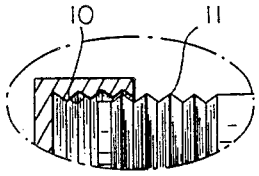
FIG. 3B shows a close-up view of the encircled portion of FIG. 3A.
Figure 4A:
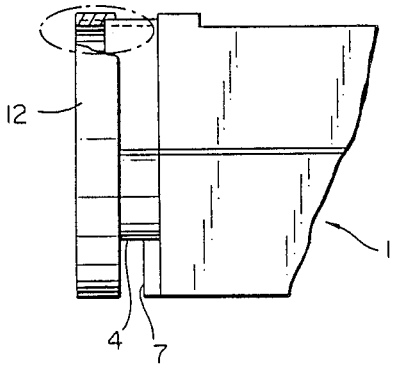
FIG. 4A shows another embodiment of the present invention including a securing ring.
Figure 4B:
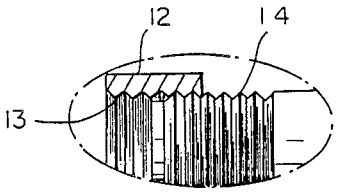
FIG. 4B shows a close-up view of the encircled portion of FIG. 4A.

As shown in FIG. 3, another possibility to provide a clamping device in connection with the support surface 4 or the contact surface 7 consists in the provision of an inner thread 10 in the housing cover 6, which cooperates with a counter thread 11 located on the housing of the paper shredder 1 in such a way that, as shown in FIG. 1, by means of turning the housing cover 6 in the direction of the arrow A, it performs a movement in the direction of the arrow B. In this manner, when the paper shredder 1 is placed on a waste receptacle 8, the edge of the waste receptacle 8 is clamped between the housing cover 6 and the contact surface 7 and the paper shredder 1 is secured against sliding in this way.

It is, of course, possible in connection with a simplified device to forego the clamping action described in connection with the support surface 4 and the contact surface 7. In this case, the support surface 4 has been kept sufficiently narrow so that the contact surface 7 and the housing cover 6 permit only limited movement in a horizontal direction when the paper shredder 1 is placed on the waste receptacle 8.

Additionally it should also be mentioned that the housing cover 6 could be replaced by a fixed housing closure. The desired clamping effect in this case could be achieved by a securing ring 12 which can be screwed on the housing by means of an inner thread 13 in the area of the housing closure which is adjacent to the support surface 4, and which has a corresponding exterior thread 14. Thus, the clamping effect between the securing ring 12 and the support surface 4 would take place by rotating the securing ring.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A housing for a paper shredder, comprising:

a slit-like paper feed on a first side of the housing;

a slit-like paper discharge having narrow sides on a second side of the housing opposite to the first side;

support surfaces for supporting the paper shredder on a waste receptacle;

the housing of the paper shredder having an elongated shape, and having a length dimension which is a multiple of a width dimension thereof, and wherein the support surfaces are disposed on each narrow side of the paper discharge; and a clamping device provided on at least one support surface for clamping the paper shredder to at least one edge of the waste receptacle.

2. A housing for a paper shredder, comprising:

a slit-like paper feed on a first side of the housing;

a slit-like paper discharge having narrow sides on a second side of the housing opposite to the first side;

support surfaces for supporting the paper shredder on a waste receptacle;

the housing of the paper shredder having an elongated shape, and having a length dimension which is a multiple of a width dimension thereof, and wherein the support surfaces are disposed on each narrow side of the paper discharge; and wherein the housing has a generally cylindrical shape and the support surfaces are formed by flattened portions on two sides of the paper discharge.

3. A housing in accordance with claim 1, wherein the clamping device comprises a contact surface limiting the second support surface in the direction of the paper discharge and a housing cover, which is spring-loaded in the direction towards the contact surface.

4. A housing in accordance with claim 1, the clamping device comprises a contact surface limiting the second support surface in the direction of the paper discharge and a housing cover connected by means of a thread with the housing of the paper shredder, so that the clamping effect takes place between the housing cover and the contact surface when rotating the housing cover.

5. A housing in accordance with claim 1, the clamping device comprises a contact surface limiting the second support surface in the direction of the paper discharge and a securing ring connected via an inner thread with the housing of the paper shredder, the inner thread of the securing ring cooperating with an exterior thread located on a jacket surface of the housing in the area of the one support surface, so that the clamping effect between securing ring and support surface takes place by rotating the securing ring.

6. A housing in accordance with claim 1, wherein a first of the support surfaces has a width in the direction in which the slit-like paper discharge extends, which is considerably greater than the width of an edge of said waste receptacle, and the second of the support surfaces has a width only insignificantly greater than the width of the edge of said waste receptacle.

7. A housing in accordance with claim 2, wherein a first of the support surfaces has a width in the direction in which the slit-like paper discharge extends, which is considerably greater than the width of an edge of said waste receptacle, and the second of the support surfaces has a width only insignificantly greater than the width of the edge of said waste receptacle.

* * * * *